US005303787A

United States Patent [19]

Brady

[11] Patent Number: 5,303,787

[45] **Date of Patent: * Apr. 19, 1994**

[54] ROTARY MINING TOOLS

[76] Inventor: William J. Brady, 1767 Wishingwell Dr., Creve Coeur, Mo. 63141

[ * ] Notice: The portion of the term of this patent subsequent to Jan. 19, 2010 has been disclaimed.

[21] Appl. No.: 4,682

[22] Filed: Jan. 14, 1993

Related U.S. Application Data

[63] Continuation-in-part of Ser. No. 704,885, May 23, 1991, Pat. No. 5,180,022.

[51] Int. Cl.[5] ..... E21B 10/54

[52] U.S. Cl. ..... 175/430; 175/421; 175/431; 175/432

[58] Field of Search ..... 175/430, 431, 432, 421, 175/379, 385

[56] References Cited

U.S. PATENT DOCUMENTS

| | | | |
|---|---|---|---|
| D. 265,205 | 6/1982 | Munson | D15/139 |
| D. 324,527 | 3/1992 | Slutz | D15/139 |
| 2,578,593 | 12/1951 | Phipps | 175/421 X |
| 2,614,814 | 10/1952 | Jones et al. | 175/421 X |
| 2,650,071 | 8/1953 | Rassieur | 175/421 X |
| 2,740,611 | 4/1956 | Bowen | 175/421 X |
| 2,930,588 | 3/1960 | Lord | 175/421 X |
| 4,098,362 | 7/1978 | Bonnice | 175/329 |
| 4,241,798 | 11/1982 | Jones | 175/329 |
| 4,303,136 | 12/1982 | Ball | 175/329 |
| 4,333,540 | 6/1982 | Daniels et al. | 175/329 |
| 4,352,400 | 10/1982 | Grappendorf et al. | 175/330 |
| 4,359,335 | 11/1982 | Garner | 75/208 R |
| 4,440,247 | 4/1984 | Sartor | 175/393 |
| 4,511,006 | 4/1985 | Grainger | 175/57 |
| 4,525,178 | 6/1985 | Hall | 51/309 |
| 4,570,726 | 2/1986 | Hall | 175/410 |
| 4,602,691 | 7/1986 | Weaver | 175/329 |
| 4,604,106 | 8/1986 | Hall et al. | 175/410 X |
| 4,682,987 | 7/1987 | Brady et al. | 51/293 |
| 4,694,918 | 9/1987 | Hall | 175/329 |
| 4,751,972 | 6/1988 | Jones et al. | 175/329 |
| 4,776,241 | 10/1988 | Pollington | 76/108 R |
| 4,819,748 | 4/1989 | Truscott | 175/410 |
| 4,858,707 | 8/1989 | Jones et al. | 175/329 |
| 4,913,244 | 4/1990 | Trujillo | 175/65 |
| 4,932,484 | 6/1990 | Warren et al. | 175/329 |
| 4,989,578 | 2/1991 | Lebourg | 125/23 |
| 5,025,874 | 6/1991 | Barr et al. | 175/329 |
| 5,180,022 | 1/1993 | Brady | 175/430 |

FOREIGN PATENT DOCUMENTS

| | | | |
|---|---|---|---|
| 2205594 | 1/1973 | Fed. Rep. of Germany | 175/421 |
| 516813 | 9/1976 | U.S.S.R. | 175/421 |
| 2115460 | 9/1983 | United Kingdom | 175/329 |

*Primary Examiner*—Hoang C. Dang
*Attorney, Agent, or Firm*—Richard G. Heywood

[57] ABSTRACT

A non-coring rotary mining tool having a bit body constructed and arranged for rock boring as in roof bolting operations, and including PCD cutter inserts of preselected size mounted at a negative angle and having substantially continuous cutting edges defining a sinusoidal cutting path from the tool axis to the gauge-cutting margins thereof; and a method of drilling rock bores utilizing moderate rotational speeds, reduced axial thrust and delivery of flushing fluids at substantially higher pressures.

24 Claims, 4 Drawing Sheets

FIG. 3A.
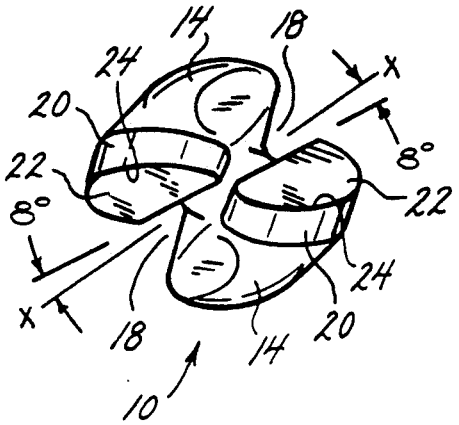
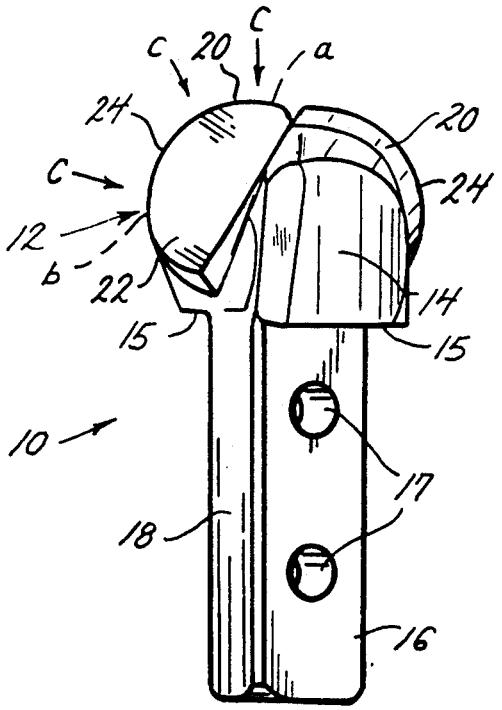
FIG. 3B.
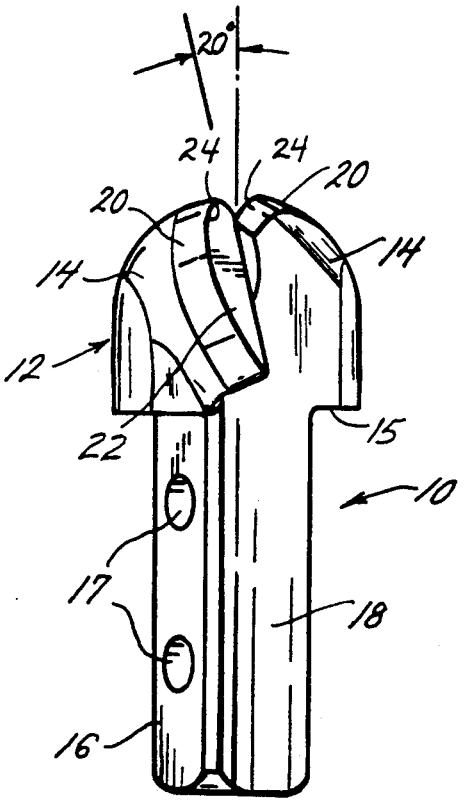
FIG. 3C.

FIG. 4A.
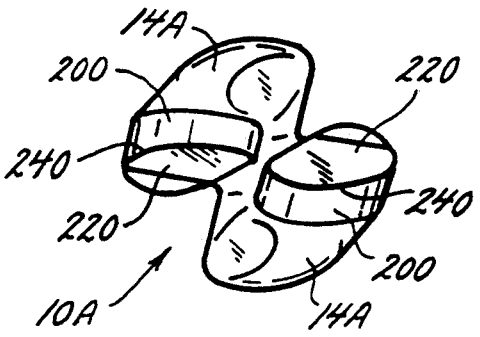
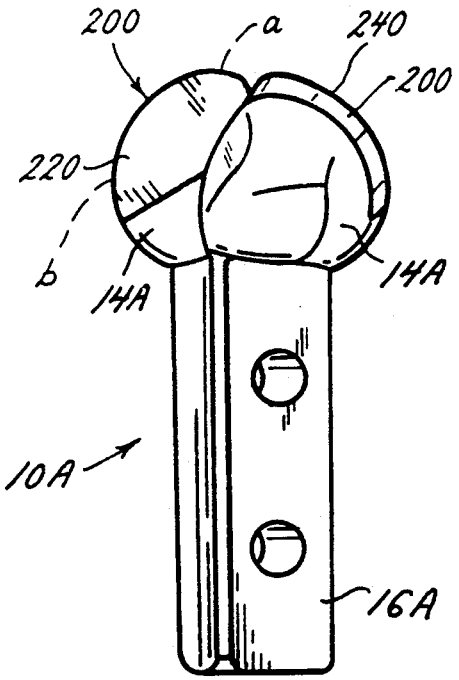
FIG. 4B.
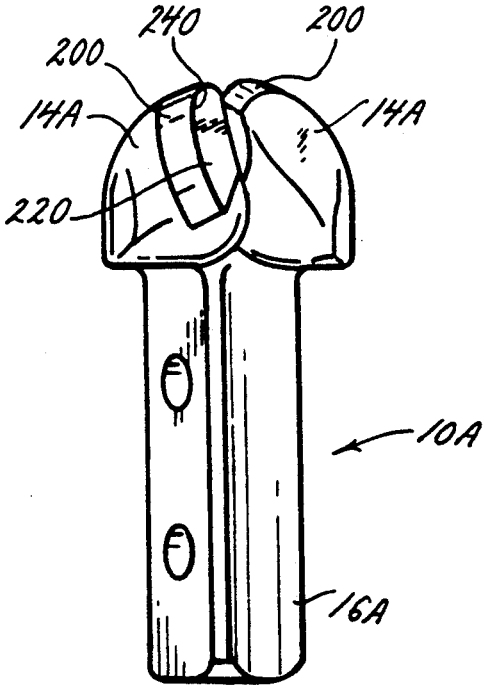
FIG. 4C.

FIG. 5A.
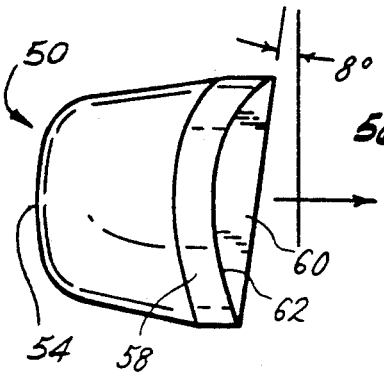
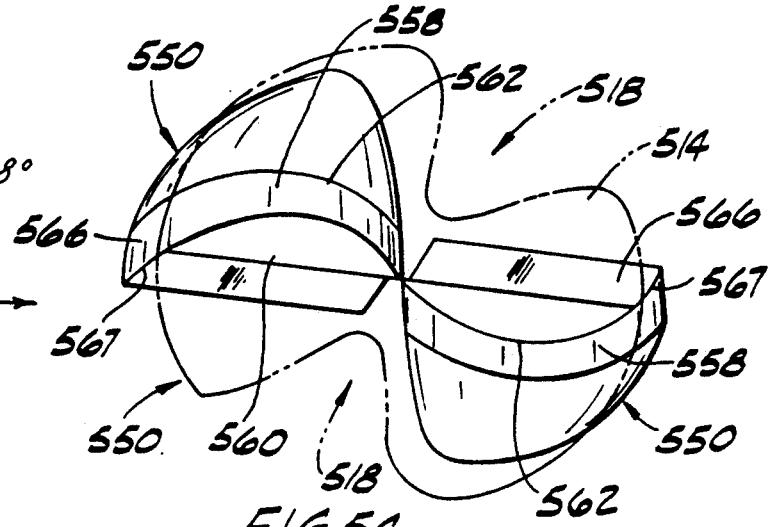
FIG. 5C
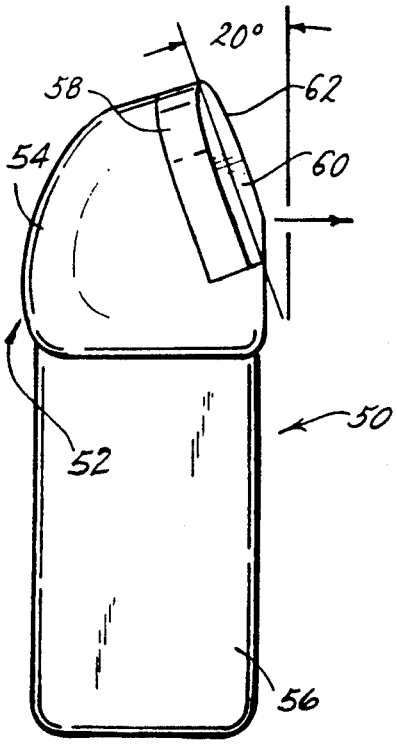
FIG. 5B.
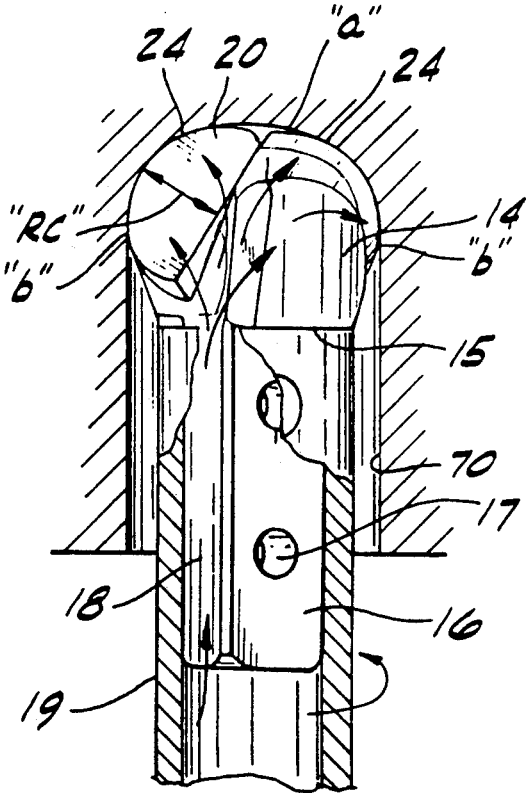
FIG. 6

ROTARY MINING TOOLS

RELATED APPLICATION

This application is a continuation-in-part application based upon U.S. patent application Ser. No. 07/704,885 filed May 23, 1991, to be issued as U.S. Pat. No. 5,180,022.

BACKGROUND OF THE INVENTION

1. Field of the Invention

This invention relates generally to industrial, mining and construction tools, and more specifically to improvements in rotary drag bits and the like for boring and drilling operations and to methods for rock mining using such tool.

As used in the following disclosure and claims, the term "polycrystalline diamond" and its abbreviation "PCD" refers to a material formed of individual diamond crystals fused or sintered by intercrystalline bonding under high pressure and temperature into a predetermined layer or shape. The PCD material is usually permanently bonded to a substrate of tungsten carbide in a cobalt binder or like carbide matrix, also known in the art as "precemented carbide". Also, as used herein, the term "high density ceramic" or its abbreviation "HDC" refer to a mining tool having an insert embodying a PCD layer.

2. Prior Art

In the past rotary drilling and coring tools, as used in mining and construction, have been constructed with hardened drill bit cutting heads, and traditionally with sintered carbide inserts to prolong the operative life of the tool. Typical cutting tools may use a single or continuous cutting surface or edge, but most frequently employ a plurality of discrete cutting elements or coring bits either sequentially and angularly arranged on a rotary bit or auger of some type. The class of heavy duty cutting tools, to which the present invention pertains, involve industrial mining and construction equipment of rotary drag type. This class generally includes rotary roof bits, longwall radial bits, auger drill bits, undercutter bits, core barrel bits, face drill bits, and two-wing, three-wing and four-wing rotary drag bits—all of which are readily identifiable to those in the mining field.

A principal problem encountered in all of these prior art tools has been the rapid wear and high cost of replacement along with machine down-time. Such rapid tool wear and breakage, in part due to higher speed equipment and heavier frictional forces and tensile stress, has led toward tool redesign with some larger carbide insert or drilling tip configurations—which in some applications has resulted in higher dust levels and increased potential ignition dangers contrary to mining safety regulations.

It is believed that a primary and inherent contributing factor in tool wear and breakage heretofore has been the conventional design configuration of such tool bits, together with traditional mining methods using combinations of heavy tool thrust and fast rotational speeds along with low pressure delivery of flushing fluids. Typically, substantially all prior tools have been constructed with a positive to zero rake angle thereby presenting a leading cutting edge or high entry point and trailing face that operates with a plow-type action and is subjected to high-point shear forces and tensile stress and drag. The typical positive angularity of cutting edge/face design produces rapid wear and failure, even in the tougher bits using tungsten carbide inserts and the like.

More recently, some substantial advances have been made in harder, tougher compositions for bit inserts. U. S. Pat. Nos. 4,525,178; 4,570,726; 4,604,106 and 4,694,918 disclose some of the basic underlying technology pertaining to such compositions and methods of making PCD materials proposed for use in various oil field drilling and mining operations as well as other machining operations. In particular, U. S. Pat. No. 4,570,726 discloses special insert shapes for coring-type rotary drill bits and suggests a tool having a working surface positioned at a slight negative angle from the perpendicular with respect to the material contacted. In fact, the '726 patent teaches away from the planar-type of working surfaces of both the prior art and the present invention and discloses specially designed curved face insert configurations for obviating the backup or build-up of loosened material against the working surface. Another U.S. Pat. No. 4,303,136 shows another coring tool having a series of drag bits with diamond surface layers carried on tungsten carbide bodies at a substantial negative rake angle, but this patent relates primarily to the orientation of the working face to hydraulic fluid passages for carrying off the loosened material.

Despite the transition toward increased use of PCD materials in rotary drag bit tools, traditional mining methods have continued to be employed. Thus, a typical prior method for obtaining optimum results in rock boring with carbide insert tools uses a fast rotational speed of about 500 to 1000 rpm with a heavy thrust of about 5000 to 13,000 psi, and wet carbide drilling conventionally uses a low water delivery pressure in the range of 60–150 psi.

SUMMARY OF THE INVENTION

The present invention is embodied in improvements in rotary mining tools of the roof drill bit type having a working wear surface disposed at negative angles and having a non-coring or substantially continuous curved cutting edge extending from its high entry point beyond the outer gauge-cutting margins and being constructed and arranged with optimum underlying body structure to minimize the effect of tensile shear forces. The invention is further embodied in methods for rock mining using such rotary mining tools with PCD inserts forming such wear surfaces and cutting edges thereon, and which methods employ new combinations of substantially less tool thrust, substantially lower rotational speeds and substantially greater flushing fluid delivery pressures.

It is an object of the present invention, therefore, to provide an improved rotary mining tool characterized by increased wear resistance and tool life; to provide a rotary mining tool configured such that tensile forces acting on the cutting edges and surfaces of the tool during operation are minimized; to provide a rotary mining tool which employs polycrystalline diamond-/tungsten carbide inserts and an optimum supporting tool body for the cutting edge thereof; to provide substantially continuous non-coring cutting edges extending diametrally across the tool; to provide PCD insert tools having optimum radial arc cutting edges and angularly disposed working surfaces; to provide novel methods of rock mining in which the tool life is greatly prolonged; to provide methods utilizing substantially increased water delivery rates; to provide methods using much lower rotational cutting speeds and much less axial thrust and tensile stress. These and still other objects and advantages will become more apparent from the detailed description which follows.

BRIEF DESCRIPTION OF THE DRAWINGS

In the accompanying drawings which form a part of the specification and wherein like numerals refer to like parts wherever they occur:

FIG. 3A is a top plan view of a preferred embodiment of a rotary drag bit of the invention;

FIG. 3B is a side elevational view of the tool of FIG. 3A;

FIG. 3C is another side elevational view of the tool of FIG. 3A as rotated 90° from the position of FIGS. 3A and 3B;

FIGS. 4A-4C are views similar to FIGS. 3A-3C showing a modified embodiment of the invention;

FIG. 5A is a top plan view of another embodiment of a rotary drag bit;

FIG. 5B is a side elevational view of the FIG. 5A tool embodiment;

FIG. 5C is a top plan view of an embodiment converting the coring tool of FIGS. 5A and 5B into a non-coring roof drill bit: and FIG. 6 is a side elevational view, partly broken away, of the improved tool of FIGS. 3A-C as applied to a drive steel and shown during a boring application.

BRIEF DESCRIPTION OF THE PREFERRED EMBODIMENTS

The present invention comprises improvements over the invention disclosure of copending U.S. patent application Ser. No. 07/704,885, to be issued as U.S. Pat. No. 5,180,022; which disclosure is hereby incorporated by reference in its entirety. As stated, the invention is generally applicable to all types of heavy duty cutting tools of the rotary drag type utilized in the industrial, mining and construction fields. This class of tools includes rotary roof bits, longwall radial bits, auger drill bits, undercutter bits, core barrel bits, face drill bits and multiple wing rotary drag bits, as will be apparent to skilled persons, particularly in coal and hard rock mining fields.

In a typical prior art method involving rotary drag bits, a roof drill bit or longwall bit is applied to coal or hard rock surfaces under a driving force in the range of 5000 to 13000 psi and normally rotated at full speeds in the range of about 500 to 1000 rpm, depending upon the application and machine design, to produce the drilling or boring result desired. Typical wet carbide drilling heretofore also utilized the delivery of water or other flushing fluids at low pressures in the range of 60-80 psi, but up to about 150 psi in some applications. The result of such prior art methods was that a single rotary drill bit using a sintered carbide insert, such as a roof drill bit of the type shown in Figs. 1A-C and 2A-C, should be expected to drill at least one four (4') foot bore before breaking or wearing out and might drill several of such bores, although in some hard rock formations two or more prior art carbide bits might be required to drill a single 4' bore. In the past this type of resulting performance level of conventional rotary drag tools was accepted as normal only because there was no better tool or known drilling technique available. However, as will be described more fully hereinafter, the basic tool invention disclosed and claimed in parent application Ser. No. 704,885 (U.S. Pat. No. 5,180,022) produced dramatic results even using the traditional methods of the prior art. In a comparison test pertaining to water pressure changes only, nine (9) PCD insert rotary bits embodying the configuration of FIGS. 3A-3C of were operated at a conventional water pressure of 80 psi drilled 12,420 feet of rock for an average of 1,380 ft./bit. In this comparison test, eighteen (18) PCD insert rotary bits embodying the same configuration of FIGS. 3A-3C were operated in the same mine at water pressures of 300 psi and drilled 72,822 feet of rock for an average of 4,056 ft./bit. The methods of the present invention will be discussed more fully hereinafter.

Figure 1B:
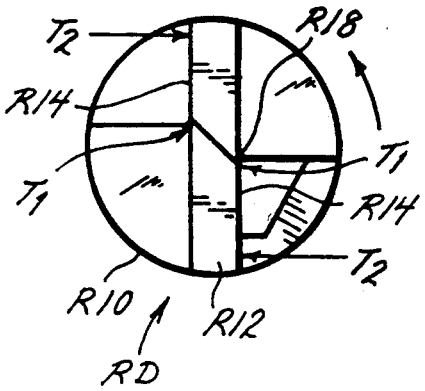
PRIOR ART FIG. 1B.
FIG. 1B is a top plan view looking downwardly on the prior art tool of FIG. 1A.
Figure 1A:
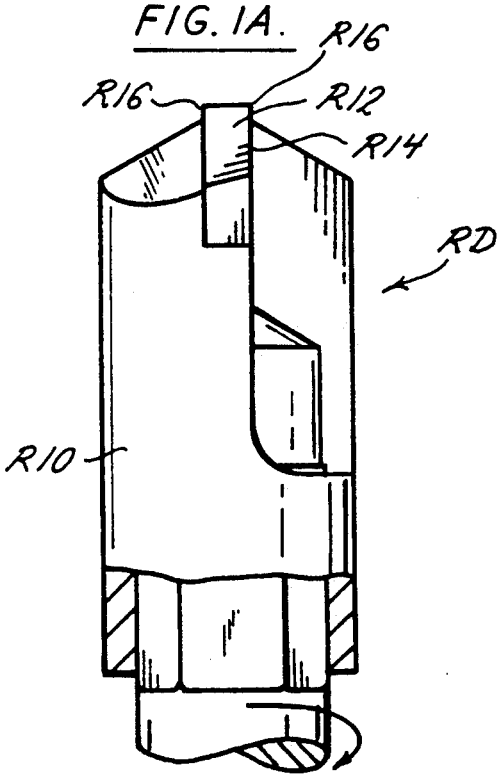
FIG. 1A is a side elevational view of a typical prior art tool illustrated for comparison purposes with the present invention.
Figure 1C:
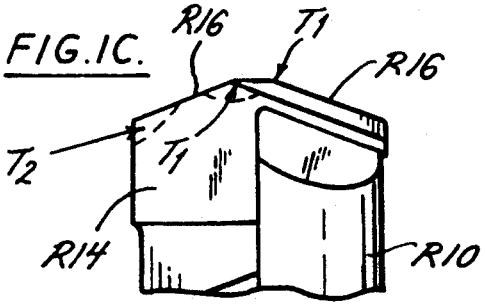
FIG. 1C is a side elevational view rotated 90° from the FIG. 1 position.

FIGS. 1A-1C and FIGS. 2A-2C are presented herein to show two typical prior art tools. FIGS. 1A-1C show a prior roof drill bit RD having a cylindrical bit body R10 with a single cutting head insert R12 typically formed of tungsten carbide. The insert R12 extends diametrically across the body R10 and forms oppositely facing vertical insert wear surfaces R14 with angular cutting edges R16. The cutting edges R16 and downwardly extending wear surfaces R14 have rake angles at zero degrees; that is both faces lie in vertically disposed (and parallel) planes relative to the axis of the bit body R12, and are substantially perpendicular or normal to the direction of rotation of the bit body 10 (FIG. 1B). As shown best in FIG. 1C, the cutting edges R16 of insert R12 are sloped or angled outwardly or upwardly to define a high entry point tip R18 for starting the bore or entry hole in the mine material. Clearly the prior art tool RD of FIGS. 1A-1C is a plow subjected to substantial tensile stress due to the zero degree (0°) rake angles of flat surfaces R14 at the cutting edges R16 being forced against the work area and the angularity of the insert corners (at $T_1$ and $T_2$) being subjected to high shear stress and drag in the adjacent surface areas delineated by broken lines thereby causing rapid wear and frequently resulting in premature insert breakage and tool failure. As will also become more apparent hereinafter, the angular design of insert R12 also provides a straight line cutting edge R16 that is limited in scope or range to about two-thirds (⅔) of the cutting range of a preferred tool of the present invention.

Figure 2B:
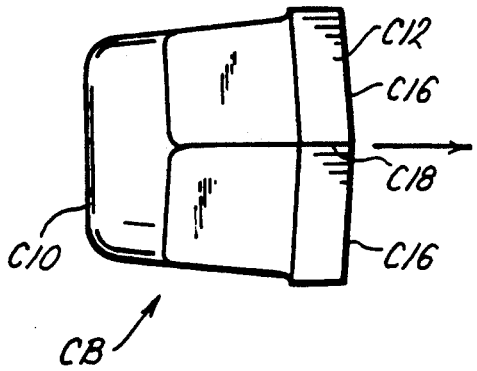
FIG. 2B is a plan view looking downwardly on the tool of FIG. 2A.
Figure 2A:
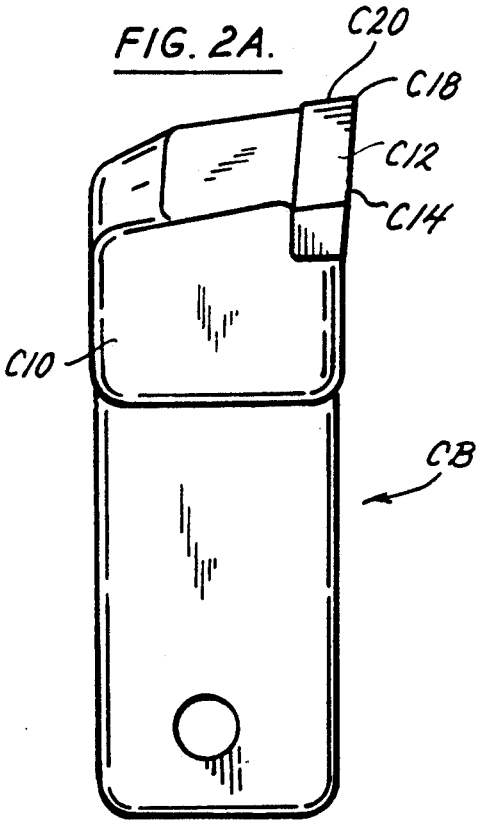
FIG. 2A is a side elevational view of another prior art tool illustrated for comparison purposes.
Figure 2C:
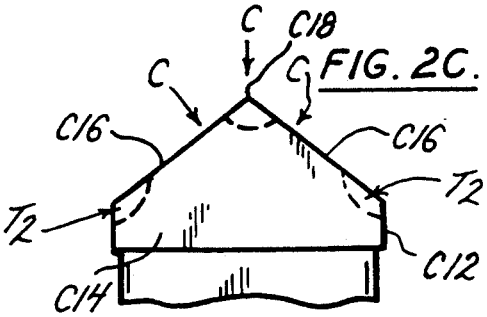
FIG. 2C is a diagrammatic representation of the compression and tension forces on the FIG. 2A tool.

FIGS. 2A-2C show a typical prior art coring bit CB having a steel body C10 forming an enlarged supporting mass or pillow block behind a cutting head insert C12 of tungsten carbide. The insert C12 provides a single, forwardly facing insert surface C14 with upwardly sloping cutting edges C16 defining a central high point entry tip C18. The cutting tool CB has a positive rake angle (FIG. 2A); that is, the entry tip C18 defines the initial entry point for forming the bore and the wear surface C14 is undercut and lies in a plane that slants downwardly and rearwardly from the tip C18 relative to both the axis and direction of rotation. This prior art tool CB, as with tool RD, is subject to high tensile stress and drag resulting in rapid dulling and breakage. It is clear that the high point tip C18 and entire cutting edge C16 on each side is in full tension T due to shear forces or torque, and that only minimum compressive forces C are exerted vertically downwardly on the upper insert wall portions C20 locate immediately behind the cutting edges C16. In addition, the angularity of this rectangular insert design is limiting upon the effective cutting edge range, making it approximately two-thirds of that of a preferred tool of the present invention.

The prior art tools having positive to zero degree rake angles, of which tool RD of FIG. 1A-C and tool CB of FIG. 2A-C are merely representative, have cutting edges and adjacent wear surfaces that work with a plowing type of action and are subjected to high tensile stress at the high driving forces and rotational speeds required to work into coal and hard rock surfaces. Clearly the cutting edges of such tools must be designed to cut clearance for the remaining tool bit structure, and at positive to zero rake angles there is little, if any, structural supporting mass behind the insert cutting edges to reinforce and minimize rapid wear and breakage. Thus, substantially the only compressive forces tending to push and hold the cutting edges on the insert and underlying tool body, are the vertical or axial forces resultant from the driving entry forces applying the bit to the work surface.

Referring now to FIGS. 3A-3C, a preferred embodiment of the invention is illustrated in the form of a roof drill bit 10 as one of the class or type of rotary drag bits to which the invention pertains. The bit 10 has a tempered steel body 12 constructed and arranged with diametrically opposite dual pillow block heads 14 on a mounting shank 16 for removably securing the bit 10 to a drilling machine (not shown) in a well-known manner. Thus, the shank 16 has bolt holes 17 for attachment to a long rod drive steel 19 of the machine (see FIG. 6), and it will be noted that the body mass 12 of the heads 14 forms a shoulder 15 to seat the machine drive steel 19. The shank 16 is provided with the usual water flutes 18 in the opposite elongated walls for channeling the hydraulic flushing fluids (i.e. mud) used for Cooling and cleaning the cutting faces of the bit 10, as will be discussed more fully hereinafter.

The roof drill bit 10 of FIGS. 3A-3C preferably utilizes a high density ceramic insert 20 on each of dual heads 14; this insert material having a "precemented carbide" base bonded onto the steel body mass and having a "polycrystalline diamond" layer fused thereon as a working wear surface 22. PCD inserts are made in the form of round discs of uniform thickness and, in the FIG. 3A-3C embodiment, one disc is cut into two semi-round halves to be applied to the oppositely facing steel body surfaces of the dual heads 14. As shown in FIG. 3B, the arcuate cutting edge 24 formed on the wear surface 22 of each insert half has an entry point "a" and curves outwardly to point "b" to cut clearance for the tool body—the effective cutting edge 24 actually extends about 15° beyond both point "a" and point "b" to define a cutting arc of approximately 120°. Thus, in comparison with the prior art tools of FIGS. 1A-1C and 2A-2C, the rotary tool bit 10 of the present invention has an effective cutting arc greater than 90° as compared to prior art cutting edges equivalent to about 65° if curved on the same circumference Further, the cutting edges of the inserts 20 come substantially together at the axis of the bit to eliminate any coring effect and to define a sinusoidal or S-shaped cutting arc extending diametrally across the tool as seen in the plan view of FIG. 3A.

The rotary drag bit 10 is constructed and arranged to position its wear faces 22 and cutting edges 24 so as to be in substantially full compression during use. FIGS. 3A-3C show that the wear surfaces 22 have a negative rake angle and a negative skew angle, as compared with prior art tools having zero to positive rake angles and no skew. As shown in FIG. 3C, each wear surface 22 of tool bit 10 has a preferred negative rake angle of about 15° to 20°, i.e. it lies in a plane that is laid back or open relative to the vertical axis of the tool and a plane "x—x" extending normal to the direction of rotation. It is believed that the operative range of negative rake angles useful in cutting tools of the present invention will be about 5° to 35° and even more preferably will be in the narrower range of 10° to 25°. As shown in FIG. 3A, each wear surface 22 has a preferred negative skew angle of about 8° relative to the same vertical plane "x—x" extending across the axis of the tool and normal to the rotational arc thereof. The operative range of negative skew angles will be about 2° to 20° and, even more preferably, will be in the range of about 4° to 10°.

It will now be apparent that a rotary drag bit 10 or like mining tool having a cutting edge (24) and wear surface (22) disposed at a substantial negative rake angle in the range of 5° to 35° and a negative skew angle in the range of 2° to 20° will produce a radial auger-type cutting action rather than a plowing action. This negative rake and skew angle combination positions the wear surface 22 to engage and be opposed by the axial thrust of the drill bit 10 acting against the work surface thereby imparting substantially total compression across the entire wear surface of the insert 20 to firmly compress and maintain it against the body mass of the pillow block head 14 to which it is bonded. Thus, the tensile stress on the inserts is held to a minimum.

Actual field tests of a prototype roof drill bit 10 of the FIG. 3A-3C design in comparison with a prior art tool RD of the FIG. 1A-1C design established that the present invention constitutes a substantial improvement in the construction and performance of rotary drag bits. In a first test, the drill bit 10 with its PDC insert 20 and a prior tool RD with a tungsten carbide insert R12 were mounted on a New Fletcher double boom roof bolter machine and applied to drill four (4') foot holes in 22000-28000 psi sandstone for anchoring resin roof bolts. The tool 10 of the present invention originally drilled five (5) of these holes and, although accidentally cracked by manual mishandling, continued to successfully drill fifteen (15) additional holes for a total of eighty (80') feet. The prior art tool RD could only drill a four (4') foot hole maximum before being dulled or broken. This test was performed at conventional drilling thrust and rotation with standard water delivery at about 80 psi.

A second test on the same equipment in the same mine was made using two (2) HDC bits for drilling four (4') foot depth holes. One of these bits ("HDC-1") drilled 100 holes of four foot depth (that is, 400 feet) and the second bit ("HDC-2") of the second test drilled 300 holes for a total of 1200 feet. A 70 hole time study of the HDC-1 bit was compared with 70 holes timed on the standard carbide bit RD. The HDC-1 bit had a penetration rate of 21-24 seconds per four foot hole operating at about 3750 psi or 75% of the axial thrust potential of the machine, as compared with a penetration rate of 26–32 seconds with full machine thrust (i.e. 5000 psi) applied to the prior art tool RD. All standard tool bits RD in this test were new or re-ground on every four foot hole. At 280 feet, the HDC-1 bit was still penetrating at 21 seconds per hole. The conclusions reached in these tests are that tools of the present invention outperform conventional prior art tools by a ratio up to about 300-1, at penetration rates of 8% to 15% faster than new or re-ground conventional bits, and with 25% less thrust in all rock conditions thereby resulting in less wear on the drill steel and machine. On the basis of the foregoing tests, it is clear that the greatly improved performance of the roof bit (10) over existing standard roof bits (RD) presently used in the coal and hard rock mining fields establish the importance of the invention.

It has been discovered that even superior and consistent performance of the tool 10 of FIGS. 3A–3C is achieved by establishing certain design parameters and modified configuration and by utilizing the novel methods herein disclosed. The roof drill bit 10 has the same basic structure as originally disclosed in parent application Ser. No. 704,885 (U.S. Pat. No. 5,180,022). However, the angle of clearance extending rearwardly from the cutting edges 24 of the PCD inserts 20 are formed optimally at about 16° and the body mass 14 supporting each insert is rounded off to freely accommodate the flow of flushing fluids into and across the back rake clearance angle to the rear margin of the insert cutting edges, at 24, as shown with reference to FIG. 6. It is even more critical that the size of the PCD insert be matched to the diameter of the tool, i.e. the bore 70 being cut. As seen, the HDC roof drill bit 10 of FIGS. 3A–3C and 6 is that of a continuous cutting screw or auger having a sinusoidal or S-curve profile (as viewed in plan) defined by a pair of oppositely facing PCD inserts. These cutter inserts 20 are angularly disposed on the supporting pillow heads 14 so that the high entry point "a" of each insert is immediately adjacent to the tool axis, and so the arcuate cutting edges 24 curve outwardly to the gauge cutting margin, at "b". Obviously, the negative rake and skew angles of the inserts are a factor in establishing the S-curve cutting edge configuration across the tool 10.

The diameter size of the insert 20 is predetermined to provide a radial arc of the cutting edge 24 that extends substantially from the tool axis to a point beyond the gauge cutting margins "b" to thereby obviate rifling of the bore. Thus, the cutting edge 24 must extend axially downwardly beyond the point "b" in order that a smooth bore diameter is established, and that the tool transmission into and forming the bore and in its withdrawal from the bore does not gouge or rifle the bore wall. Thus, the diameter of the PCD insert must be in proportion to the bore diameter to be cut so that the radius of the curving cutter edge 24 (i.e. radial arc) does not bring it past the gauge margin "b" at too great a curve so that it fails to maintain the reaming effect at this margin. A larger, slower curve of the radial arc will provide optimum boring. The following chart establishes the optimum size of PCD inserts for the respective working diameter bores of tools:

| Size of Tool | PCD Diameter | PCD Radial Arc |
|---|---|---|
| 1" to 1¼" | ¾" | ⅜" |
| 1⅜" to 1⅝" | 1" | ½" |
| 1½" to 1¾" | 1⅛" | 9/16" |

It may be noted that PCD technology has only recently been able to create the larger sized PCD inserts to facilitate the completion of applicant's development and testing programs. Heretofore, only ½" to ¾" diameter PCD inserts have been available.

It has also been discovered that optimum performance of the tool 10 is achieved at some variance in negative rake and negative skew angles relative to the original prototype testing models of the parent application, due in part to the availability of larger sized inserts and tools. HDC bits designed with skew angles in a range of 2° to 20° will work, but with angles of 4° or less the bits act like a plow in certain rock formations and require greater thrust for penetration. Because the gauge clearance is less (side clearance) and as the bit dulls more readily due to regrinding cut material, footages attained with the lower skew angles are also lower. Negative skew angles greater than 10° show a rapid decline in penetration due to skidding rather than cutting and more bond failures occur due to greater thrust required to penetrate the rock formations. In short, the HDC bit has a continuous cutting action and, if the pitch is too great or too small, efficiency is substantially reduced or lost. Accordingly, the optimum pitch or negative skew on the cutting edges is attained when using a 4° to 8° skew angle. This range of angles maximizes cutting efficiency and allows for fast removal of cut materials. With regard to negative rake angles, it has been determined that the newly tested larger sizes of roof drill bits are most efficient using an optimum angle of 15°.

Referring to FIGS. 4A–4C, a modified form of the preferred embodiment is illustrated. In this form, the roof drill bit 10A may have the same basic structure as the FIG. 3A–3C embodiment, except that the oppositely facing inserts 200 are formed by cutting a PCD insert disc (not shown) into three segments, each of which has an effective cutting edge 240 with a 120° arc. Thus, a thirty-three (33%) percent savings in HDC insert costs can be achieved without any substantial loss of performance. It is clear that the wear surface 220 of the FIG. 4A–4C tool embodiment has a negative rake angle in the range of 5° to 35°, and preferably about 20°; and also has a negative skew angle in the range of 2° to 20°, and preferably about 8°. It should be noted that the body mass of the pillow head 14A extends under and seats the insert 200 to minimize damage of the bore hole wall particularly during removal of the tool.

Referring to FIGS. 5A and 5B, another type of rotary drag bit 50 embodies the invention as an improvement over the prior art tool CB of FIGS. 2A–2C. This coring bit 50 includes a steel body 52 with an enlarged pillow block 54 on the end of shank 56. An HDC insert 58 is bonded to the support head 54 and has a wear surface 60 positioned at a negative rake angle in the range of 5° to 35° and a negative skew angle of 2° to 20°, both relative to a vertical plane extending normal to the direction of rotation of the tool 50. As shown the preferred negative rake angle is 20°, and the preferred negative skew angle is 8°. The insert 58 is in the shape of a half-round disc thereby eliminating angular corners having the high tensile stresses of prior art tools, such as coring bit CB of FIGS. 2A–2C, and the arcuate cutting edge 62 has an effective sweep in the range of 120°–180°.

It will be understood that although the coring bit 50 of FIGS. 5A and 5B illustrates the application of negative rake and skew angles useful in improved multiple-bit coring tools, this embodiment is best employed in the paired cutter insert tool of FIG. 5C. In this configuration the dual bits 550 are mounted on a bit body 514 with the cutter inserts 558 being oppositely facing in the direction of tool rotation and disposed at negative rake and skew angles to form sinusoidal continuous cutting edges 562 across the tool diameter. This tool also employs side or gauge-cutting reamers 566 having cutting edges 567 lying in the same plane as the insert wear surfaces 560 and forming a continuation or extension of the gauge-cutting outer end of the inserts to thereby assure proper bore is formed without rifling.

With particular reference to FIG. 6, the methods of the present invention will now be discussed more fully. A roof drill bit 10 or like rotary tool is attached to a drill steel or column 19 in a conventional way, such as by seating the drive steel column against the shoulders 15 of the body mass 12 and attaching it to the shank 16 as with bolts. The water flutes 18 in opposite shank walls are thus confined by the drive column for delivery of water or like flushing fluid (i.e. drilling mud) to the head portion of the tool. The primary object of the present drilling methods is to deliver high volumes of water to the PCD inserts to flush away debris and to cool the inserts, particularly at the heat generating cutting edges 24. Therefore, in the present invention the water pressure is increased dramatically over conventional drilling techniques to a dynamic pressure in the range of 150 to 400 psi; preferably in the range of about 275 to 350 psi; and optimally at about 325 psi.

Another feature of the present method is to reduce the axial thrust applied to the tool, which is a primary cause of broken inserts, bit wear and broken drive steel or shank connections, and the like. Prior art roof drill bits frequently required essentially full thrust (from 5000 to 13,000 pounds) in order to advance into and plow the bore hole open. It has now been discovered that the improved cutting action of the present roof drill bit invention can operate at more efficient cutting speeds with substantially lower applied thrust in the range of 2200 to 3200 pounds, preferably in the range of about 2500 to 2900 pounds. The optimal thrust varies among applications such that, for example, the optimal thrust when using a drill bit constructed to cut bores having a diameter in the range of $1\frac{3}{8}$ to $1\frac{3}{4}$ inches under certain conditions may be about 2700 pounds whereas the optimal thrust when using a drill bit constructed to cut bores having a diameter in the range of 1 to $1\frac{1}{4}$ inches under certain conditions may be about 2500 pounds. Thrust settings on the drill should be set with an ENERPAC Load Cell Thrust Gauge (LC 502) for consistent results. However, the hydraulic psi on Fletcher drills can be reduced to about 950 to 1000 psi (from the usual 1550–2000 psi setting) which results in about 3000 pounds of thrust.

The third feature of the present method involves the rotational speed of the drill bit. The drill bits of the present invention are found to perform exceptionally well when operated at moderate rotational speeds in the range of 300 to 750 rpm, preferably in the range of about 450 to 550 rpm, optimally about 485 rpm. It has been noted that there is a correlation between rpm and water pressure, and that the higher range of rotational speeds should be employed with the upper ranges of water pressure, and that the effective life of HDC insert bits has been increased up to 70% by using the higher water volumes.

In operation, with the drill bit 10 secured to the drive steel 19 of a dual boom Fletcher roof bolter (not shown) or the like, the machine operator identifies or marks the desired hole locus and then initiates the drilling operation in a conventional manner by first collaring into the rock surface at low thrusts and minimum rotational speed (if available) and water delivery. The Fletcher bolter (and other comparable machines) may be provided with a variable adjustment for rotational speed, so this feature of the method may be preselected and set into the machine in advance at the optimum or desired rotation within the moderate range of 300 to 750 rpm. When the bore is established, the operator then increases the thrust on the bit up to the maximum preset machine thrust potential in the range of 2200 to 3200 pounds, which according to the invention is substantially lower than the usual machine thrust of between 5000 and 13000 pounds. At this time the operator also applies full water pressure for delivery to the bit inserts at dynamic pressures in the range of 150 to 400 psi.

It is now apparent that the objects and advantages of the present invention over the prior art have been fully met. Changes and modifications to the disclosed forms of the invention will become apparent to those skilled in the mining tool art, and the invention is only limited to the scope of the appended claims.

What is claimed is:

1. A non-coring rotary tool having a bit body with a shank portion constructed and arranged for attachment to a drill column for rotation on a central axis, and with a cutter head portion constructed and arranged for drilling and boring as in roof bolting operations in tunnel construction and mining;

a pair of cutter inserts formed from a polycrystalline diamond disc of predetermined diameter size to thereby define a curved outer cutting edge having a predetermined radial arc on each insert, said pair of cutter inserts also having substantially planar wear surfaces extending from the cutting edges thereof;

said pair of cutter inserts being mounted on said cutter head portion with said wear surfaces being oppositely oriented to face in the direction of rotation of said bit body, and with said wear surfaces being at a predetermined negative angle relative to an axial plane normal to the direction of rotation and extending across the diameter of the cutter head portion; and said cutting edges of said pair of cutter inserts having outer gauge-cutting margins defining a predetermined bore diameter to be formed by the tool, and the cutting edges extending along reversely curving arcuate paths substantially continuously from the rotational axis of the tool to the gauge cutting margins.

2. The rotary tool of claim 1, in which the bore diameter defined by the gauge-cutting margins is in the range of 1 to $1\frac{1}{4}$ inches, and the predetermined diameter size of the cutter inserts is substantially $\frac{3}{4}$ inch.

3. The rotary tool of claim 2, in which the negative angle of said wear surfaces is a negative skew angle in the range of about 4° to 8°.

4. The rotary tool of claim 2, in which the negative angle of said wear surface is a negative rake angle in the range of about 10° to 25°.

5. The rotary tool of claim 4, in which the negative rake angle is about 20°.

6. The rotary tool of claim 1, which the bore diameter defined by the gauge-cutting margins is in the range of $1\frac{3}{8}$ to $1\frac{1}{2}$ inches, and the predetermined diameter size of the cutting inserts is in the range of 1 to $1\frac{1}{8}$ inches.

7. The rotary tool of claim 6, in which the cutting insert diameter size is optimally 1 inch.

8. The rotary tool of claim 6, in which the negative angle of said wear surface is a negative skew angle in the range of about 4° to 8°.

9. The rotary tool of claim 6, in which the negative angle of said wear surface is a negative rake angle in the range of about 10° to 20°.

10. The rotary tool of claim 9, in which the negative rake angle is about 15°.

11. The rotary tool of claim 11, in which the bore diameter defined by the gauge-cutting margins is in the range of $1\frac{5}{8}$ to $1\frac{3}{4}$ inches, and the predetermined diameter size of the cutter inserts is in the range of 1 to $1\frac{1}{8}$ inches.

12. The rotary tool of claim 11 in which the cutter insert diameter size is optimally $1\frac{1}{8}$ inch.

13. The rotary tool of claim 11, in which the negative angle of said wear surface is a negative skew angle in the range of about 4° to 8°.

14. The rotary tool of claim 11, in which the negative angle of said wear surface is a negative rake angle in the range of about 10° to 20°.

15. The rotary tool of claim 14, in which the negative rake angle is about 15°.

16. The rotary tool of claim 11, in which the radial arc of the cutting edges extends substantially beyond the gauge-cutting margins to thereby obviate rifling.

17. The rotary tool of claim 1, including other cutting means extending beyond the gauge-cutting margins of said insert cutting edges for reaming the bore to gauge and obviate rifling.

18. The rotary tool of claim 11, which includes means for distributing flushing fluids to said head portion and to the cutter inserts thereof, said head portion and cutter inserts being constructed and arranged to receive such flushing fluids at substantial fluid pressures and accommodate such distribution thereof over the entire cutter insert wear surfaces and cutting edges and over the supporting head portion structure.

19. The rotary tool of claim 1, in which the curved arcuate path of the cutting edge on each insert has a radial arc of about 120°.

20. A roof drill bit comprising:

a bit body having a shank portion constructed and arranged for attachment to a drill column for rotation on a central axis and having a cutter head portion constructed and arranged for drilling and boring as in roof bolting operations in industrial mining and tunnel construction, said head portion having a pair of support surfaces oppositely oriented in the direction of rotation of said bit body; and a pair of cutter inserts each of which is rigidly bonded to one of the head portion support surfaces and includes a polycrystalline diamond layer defining an outer cutting edge and an adjacent, substantially planar wear surface extending therefrom;

the planar wear surface of each insert having a negative rake angle and also being positioned at a negative skew angle in the range of 4° to 8°; and said cutting edges of said pair of cutter inserts having outer gauge-cutting margins and high entry points located substantially closer to the rotational axis of the tool than to the gauge-cutter margins, and said cutting edges extending along arcuate paths substantially continuously from the rotational as of the tool to said gauge-cutting margins.

21. The roof drill bit according to claim 20, in which the negative rake angle of each wear surface is in the range of 10° to 25°.

22. The roof drill bit of claim 20, in which the bore diameter defined by the gauge-cutting margins of the cutter inserts is relatively small and in the range of 1 to $1\frac{1}{4}$ inches, and said negative rake angle is about 20°.

23. The roof drill bit of claim 20, in which the bore diameter defined by the gauge-cutting margins of the cutter inserts is relatively large and in excess of 1 to $1\frac{1}{4}$ inches, and the negative rake angle is about 15°.

24. A non-coring rotary tool having a bit body with a shank portion constructed and arranged for attachment to a drill column for rotation on a central axis, and with a cutter head portion constructed and arranged for drilling and boring as in roof bolting operations in tunnel construction and mining;

a pair of high density ceramic cutter inserts formed with a polycrystalline diamond layer and each insert having a curved outer cutting edge and a substantially planar wear surface extending therefrom;

said pair of cutter inserts being mounted on said cutter head portion with said wear surfaces being oriented on opposite sides of an axial plane extending across the diameter of the cutter head portion so as to face in the direction of rotation of said bit body, and with the plane of each wear surface being formed at a negative angle taken relative to the axial plane; and said cutting edges of said pair of cutter inserts having outer gauge-cutting margins defining a predetermined bore diameter to be formed by the tool, and the cutting edges extending along reversely curving arcuate paths substantially continuously from the rotational axis of the tool to the outer gauge cutting margins.

* * * * *

UNITED STATES PATENT AND TRADEMARK OFFICE

CERTIFICATE OF CORRECTION

PATENT NO. : 5,303,787

DATED : April 19, 1994

INVENTOR(S) : William J. Brady

It is certified that error appears in the above-identified patent and that said Letters Patent is hereby corrected as shown below:

Column 5, line 43, "Cooling" should be --cooling--.

Column 11 (claim 11), line 13, "claim 11" should be --claim 1--.

Column 11 (claim 16), line 29, "claim 11" should be --claim 1--.

Column 11 (claim 18), line 36, "claim 11" should be --claim 1--.

Column 12 (claim 20), line 14, "gauge-cutter" should be --gauge-cutting--; line 16, "as" should be --axis--.

Signed and Sealed this

Twenty-third Day of August, 1994

*Attest:*

Bruce Lehman

BRUCE LEHMAN

*Attesting Officer*

*Commissioner of Patents and Trademarks*